US007621209B2

(12) United States Patent
Bateman et al.

(10) Patent No.: US 7,621,209 B2
(45) Date of Patent: Nov. 24, 2009

(54) MODULAR BALLISTIC WALL

(75) Inventors: Kyle Bateman, Provo, UT (US); David Bassett, Springville, UT (US)

(73) Assignee: Action Target Acquisition Crop., Provo, UT (US)

( * ) Notice: Subject to any disclaimer, the term of this patent is extended or adjusted under 35 U.S.C. 154(b) by 210 days.

(21) Appl. No.: 10/602,547

(22) Filed: Jun. 24, 2003

(65) Prior Publication Data

US 2005/0022658 A1 Feb. 3, 2005

Related U.S. Application Data

(60) Provisional application No. 60/395,540, filed on Jul. 12, 2002.

(51) Int. Cl.
*F41J 1/12* (2006.01)

(52) U.S. Cl. ..... 89/36.02; 273/410

(58) Field of Classification Search ..... 273/410; 89/36.01, 36.04, 36.02; 270/410
See application file for complete search history.

(56) References Cited

U.S. PATENT DOCUMENTS

| | | | | |
|---|---|---|---|---|
| 385,846 | A | 7/1888 | Decumbus | |
| 694,581 | A | 3/1902 | Reichlin | |
| 774,959 | A | 11/1904 | Tresidder | |
| 840,610 | A | 1/1907 | Easdale | |
| 941,642 | A | 11/1909 | Maxim | |
| 980,255 | A | 1/1911 | Herms et al. | |
| 1,035,908 | A | 8/1912 | Richardson | |
| 1,155,717 | A | 10/1915 | Fouts | |
| 1,199,357 | A | 9/1916 | Evans, Jr. | |
| 1,803,514 | A | 5/1931 | Thomas | |
| 1,957,933 | A | 5/1934 | Brandl | |
| 2,013,133 | A * | 9/1935 | Caswell | 273/410 |
| 2,054,665 | A | 9/1936 | Tracy | |
| 2,105,784 | A | 1/1938 | Hagberg | |
| 2,170,637 | A | 8/1939 | Hatch et al. | |
| 2,208,010 | A | 7/1940 | Whitmore | |
| 2,209,580 | A | 7/1940 | Sargent | |
| 2,212,982 | A | 8/1940 | Drain, Jr. et al. | |
| 2,231,528 | A | 2/1941 | Daniels | |

(Continued)

FOREIGN PATENT DOCUMENTS

| | | |
|---|---|---|
| AU | 127432 | 4/1946 |

(Continued)

OTHER PUBLICATIONS

Product Literature, Caswell International Corp., Copyright 2002.

(Continued)

*Primary Examiner*—Troy Chambers
(74) *Attorney, Agent, or Firm*—Bateman IP Law Group

(57) ABSTRACT

A modular ballistic wall is disclosed for use in shoot houses and the like. The modular ballistic wall can be formed from metal plates having key-holes formed therein which are held together by facing and backing strips. Additionally, the modular ballistic wall is preferably formed so that the bolts used to hold the facing and backing strips to the metal plates do not directly secure a bullet containment frame to the facing and/or backing strips, to thereby prevent damage to the bullet containment frame from weakening the joint formed by the metal plates and the facing and backing strips.

28 Claims, 9 Drawing Sheets

U.S. PATENT DOCUMENTS 2,269,490 A 1/1942 Slick
2,350,827 A 6/1944 Saulnier
2,410,922 A 11/1946 Balduf
2,411,026 A 11/1946 Conner et al.
2,412,242 A 12/1946 Beaud
2,412,342 A 12/1946 Beaud
2,420,304 A 5/1947 Diem
2,518,445 A 8/1950 Benson
2,628,388 A 2/1953 Poth
2,631,454 A 3/1953 Shepard et al.
2,713,262 A * 7/1955 Webster ..... 73/167
2,772,092 A 11/1956 Nikoden
2,927,665 A 3/1960 Hauf
2,932,860 A 4/1960 Barth
3,263,385 A 8/1966 Pauls
3,398,496 A 8/1968 Mischke
3,404,887 A 10/1968 Dundr
3,423,891 A 1/1969 Burris
3,447,806 A 6/1969 Pfaff et al.
3,485,405 A 12/1969 Dement
3,530,633 A 9/1970 Scott
3,567,223 A 3/1971 Gentiluomo
3,619,437 A 11/1971 McDonald
3,701,532 A 10/1972 Nikoden
3,737,165 A 6/1973 Pencyla
3,969,855 A 7/1976 Lendi
3,982,761 A 9/1976 DeVogelaere
4,028,856 A 6/1977 Dalbec
4,126,311 A 11/1978 Wagoner
4,254,600 A 3/1981 Zwissler
4,272,078 A 6/1981 Vinette
4,294,452 A 10/1981 Schlotter et al.
4,317,572 A 3/1982 Iseli
4,445,693 A 5/1984 Angwin
4,458,901 A 7/1984 Wojcinski
4,512,585 A 4/1985 Baravaglio
4,677,798 A 7/1987 Phillips
4,728,109 A 3/1988 Simonetti
4,786,059 A 11/1988 Barini
4,787,289 A 11/1988 Duer
4,819,946 A 4/1989 Kahler
4,821,620 A 4/1989 Cartee et al.
4,846,043 A 7/1989 Langsam
4,856,791 A 8/1989 McQuade
4,919,437 A 4/1990 Salabée et al.
5,040,802 A 8/1991 Wojcinski et al.
5,070,763 A 12/1991 Coburn
5,085,765 A 2/1992 Salabé et al.
5,113,700 A 5/1992 Coburn
5,121,671 A 6/1992 Coburn
D329,680 S 9/1992 Burn
5,163,689 A 11/1992 Bateman
5,171,020 A 12/1992 Wojcinski
5,255,924 A 10/1993 Copius
5,340,117 A 8/1994 Wojcinski
5,400,692 A 3/1995 Bateman
5,405,673 A 4/1995 Seibert
5,435,571 A 7/1995 Wojcinski et al.
5,441,280 A 8/1995 Copius
5,535,662 A 7/1996 Bateman
5,564,612 A 10/1996 Gregory
5,600,084 A * 2/1997 Gonzalez ..... 89/36.02
5,607,163 A 3/1997 Nesler
5,663,520 A * 9/1997 Ladika et al. ..... 89/36.08
5,738,593 A 4/1998 Coury et al.
5,811,718 A 9/1998 Bateman
5,822,936 A * 10/1998 Bateman ..... 52/281
5,848,794 A 12/1998 Wojcinski et al.
6,027,120 A 2/2000 Wojcinski et al.
6,311,980 B1 11/2001 Sovine et al.
6,378,870 B1 4/2002 Sovine et al.
6,438,906 B1 * 8/2002 Komarowski et al. ..... 52/169.1
6,484,990 B1 11/2002 Marshall
6,533,280 B1 3/2003 Sovine et al.
6,588,759 B1 7/2003 Bateman et al.
6,776,418 B1 8/2004 Sovine et al.
6,808,178 B1 10/2004 Sovine et al.
6,975,859 B1 12/2005 Lambert et al.
6,994,348 B2 2/2006 Lambert et al.
6,994,349 B2 2/2006 Lambert et al.
7,140,615 B1 11/2006 Sovine et al.
7,175,181 B1 2/2007 Bateman et al.
7,194,944 B2 3/2007 Lambert et al.
7,219,897 B2 5/2007 Sovine et al.
7,234,890 B1 6/2007 Marshall et al.
7,264,246 B2 9/2007 Sovine et al.
7,275,748 B2 10/2007 Lambert et al.
7,303,192 B2 12/2007 Marshall et al.
7,306,230 B2 12/2007 Lambert et al.
7,322,771 B1 1/2008 Marshall et al.
2005/0022658 A1 2/2005 Bateman et al.
2006/0220319 A1 10/2006 Lambert et al.
2006/0234069 A1 10/2006 Sovine et al.
2006/0240388 A1 10/2006 Marshall et al.
2006/0240391 A1 10/2006 Sovine et al.
2007/0040334 A1 2/2007 Marshall et al.
2007/0045985 A1 3/2007 Markley
2007/0069472 A1 3/2007 Lambert et al.
2007/0072537 A1 3/2007 Bateman et al.
2007/0102883 A1 5/2007 Parks et al.
2007/0114724 A1 5/2007 Bassett et al.
2007/0235943 A1 10/2007 Bateman et al.
2008/0208425 A1 8/2008 Riccoti et al.

FOREIGN PATENT DOCUMENTS

AU 202340 8/1954
CH 597451 A5 4/1978
DE 227342 10/1910
DE 498308 5/1930
DE 877489 5/1953
DE 2021 170 11/1971
DE 36 35 741 A1 7/1992
FR 832754 10/1938
FR 849 829 12/1939
FR 1156211 5/1958
FR 2461069 7/1980
GE 280832 11/1927
GE 514123 11/1930
GE 725189 3/1955
NL 7700295 7/1978

OTHER PUBLICATIONS

Porta Target Shoot House circa 1997.
U.S. Appl. No. 10/287,191, filed Nov. 4, 2002, Bateman et al.
U.S. Appl. No. 11/494,788, filed Jul 26, 2006, Bateman et al.
U.S. Appl. No. 11/349,739, filed Feb. 8, 2006, Bateman et al.
U.S. Appl. No. 11/349,738, filed Feb. 8, 2006, Bateman et al.
U.S. Appl. No. 11/506,763, filed Aug. 18, 2006, Sovine et al.
U.S. Appl. No. 11/506,413, filed Aug. 17, 2006, Wright et al.
U.S. Appl. No. 11/530,280, filed Aep. 8, 2006, Marshall et al.
U.S. Appl. No. 11/745,077, filed May 7, 2007, Bassett et al.
Office Action of Feb. 6, 2008 (Pertinent Parts) U.S. Appl. No. 10/287,191, and currently pending claims.

* cited by examiner

MODULAR BALLISTIC WALL

RELATED APPLICATION

The present application claims the benefit of U.S. Provisional Application 60/395,540, filed Jul. 12, 2002, which is expressly incorporated herein.

BACKGROUND OF THE INVENTION

1. Field of the Invention

The present invention relates to a modular ballistic wall for decelerating projectiles. More specifically, the present invention relates to a wall which may be used in shoot houses, baffles, and the like, for safely decelerating projectiles.

2. State of the Art

In order to maintain proficiency in the use of firearms, it is common for law enforcement officers and sportsmen to engage in target practice. While target practice has traditionally been conducted on a range in which targets were placed a distance away from the shooter, many have realized that such a scenario does not adequately train officers for many real life situations. For example, a substantial percentage of the police officers who are killed each year are killed within fifteen feet of the perpetrator. Many are killed within five feet—often within the confines of a house or other building.

In order to better train police officers, many began building ballistic walls in arrangements to resemble a house or other building. These structures, typically referred to as shoot houses, enabled police officers to train in situations in which the officer faces realistic threats to their safety.

Shoot houses were originally constructed out of a concrete, gravel filled walls, or tire walls. While these shoot houses provided marked improvement over traditional training, they still do not feel as realistic as conventional looking walls.

A significant improvement in shoot houses was achieved with the invention of modular shoot house walls in which plates of steel were attached together in a ballistically sound manner and then covered by a frame. The frame typically had two-by-fours attached to facing strips that held the plates together, and pieces of plywood that connected the two-by-fours. A more detailed description of a preferred construction of the shoot house is set forth in U.S. Pat. No. 5,822,936.

When the plywood was painted, the shoot house looked very similar to a conventional home with the roof removed. In such a shoot house, the officer is able to train in a ballistically safe environment that closely resembles what may be the most dangerous scenario that he will face.

While U.S. Pat. No. 5,822,936 teaches that a preferred embodiment of the invention avoids the necessity of cutting holes in the plate, some have insisted that the bolts which hold the facing and backing strips to the plates extend through the plates. This is due to an erroneous understanding perpetuated by some that the clamping of the facing and backing strips together against the plates leaves the wall prone to separation.

The disadvantage of cutting holes in the plates is that each time the cutting torch is turned off, there is an associated cost. In order to properly secure the plates and prevent bullet fragments from passing through joints in the wall, as many as eight attachment points should be used. Thus, even if the cost associated with turning off and on the torch is only $0.20, the cost associated with a single plate can be several dollars.

Thus, there is a need to form a modular ballistic wall which does not have the associated costs of repeatedly turning off the cutting torch, while providing the perceived benefit of the attachment bolts going through the plates.

Another problem which is present in some modular shoot houses is the method by which the two-by-fours are attached to the facing strips. In one currently marketed arrangement, the two-by-fours are drilled and the attachment bolts extend through the two-by-fours, the facing strip, the plates and the backing strip. Such an arrangement is fundamentally flawed. As bullets impact the two-by-four adjacent the bolts, the two-by-four will be damaged by each round. Over time the support given to the bolt by the two-by-four will decrease and the bolt will become loose. Once the bolt is able to move, the facing and backing strips are no longer held securely against the plate and the risk that a bullet or bullet fragment will pass through the seam between the plates increases significantly.

The risks associated with loose bolts can be avoided by making sure that a substantial number of the attachment bolts hold the facing and backing strips together without passing through the two-by-four. Such a situation, however, still raises the concern that the two-by-fours must be milled or otherwise handled so that the holes for the bolts can be drilled therein. This usually results in the wood being shipped to the job site from the same location as the metal plates, facing strip, etc. If drilling holes in the wood can be avoided, the wood can be purchased at a hardware store close to the site at which the range is being built. This can significantly decrease costs depending on the location of the shoot house.

Thus, there is needed an improved mechanism for attaching a wood or other containment frame to the facing strips. Ideally, such a mechanism would not use attachment bolts used to secure the facing strip and backing strip to the metal plates.

SUMMARY OF THE INVENTION

It is an object of the present invention to provide an improved modular ballistic wall.

It is another object of the invention to provide such a modular ballistic wall which is relatively inexpensive to construct and relatively easy to assemble.

In accordance with the above and other objects of the invention a modular ballistic wall is disclosed which includes a plurality of metal plates, facing strips and backing strips (or similar structure) which are connected together to prevent bullets from passing through the wall.

In accordance with one aspect of the invention, the plates have keyholes formed therein for receiving bolts so that the bolts pass through the hole in the plates. The use of keyholes eliminates the cost associated with turning a cutting torch off and on repeatedly. By using keyholes, it has been found that more holes can be formed in the plate at the same price. This allows for more attachment locations along the plates, and thereby reduces the risk of a bullet passing through the seam.

In accordance with another aspect of the invention, the bullet containment frame is attached to the facing strips without the need for bolts to extend through the frame. In one preferred embodiment of this aspect of the invention, the facing strip is formed with a channel for receiving a two-by-four or similar frame member. The two-by-four is attached directly to the facing strip. This, in turn, prevents the bolts from being loosened in the event that the two-by-four is damaged by bullets.

Another advantage associated with this configuration is that the facing strip and/or backing strip can be formed as a load bearing structure. This enables a second story of a shoot house, ballistic plates or a roof to be added to the shoot house without requiring additional supporting structure as is commonly required with current shoot house embodiments.

In accordance with another aspect of the present invention, the two-by-four, etc., is attached to the facing strip by an attachment bracket which is attached to the facing strip. The bracket can be disposed either on the inside or the outside of the facing strip and extend into an engagement with the two-by-four.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
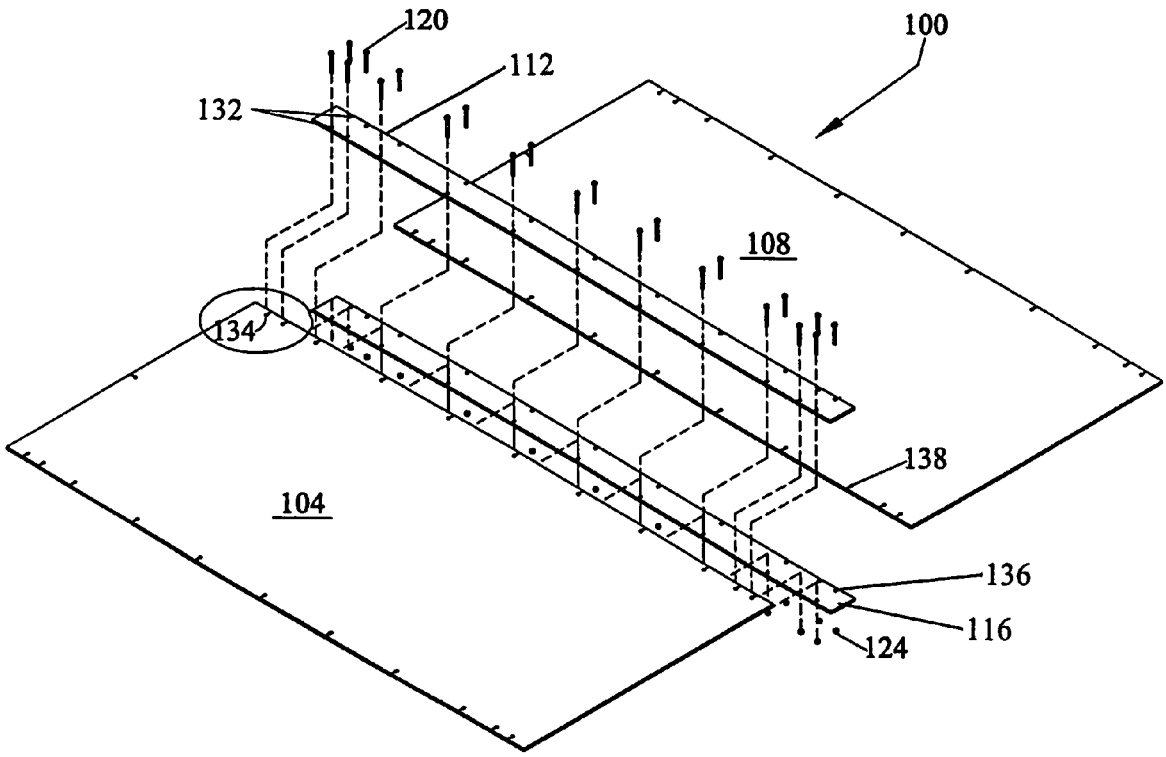
FIG. 1 shows two metallic plates and attachment structures for forming a ballistic wall made in accordance with the principles of the present invention.

Referring to FIG. 1, there is a disassembled portion of a ballistic wall, generally indicated at 100, made in accordance with the principles of the present invention. The ballistic wall 100 includes a pair of plates 104 and 108 which, as will be discussed in detail below, are attached together by a facing strip 112 and a backing strip 116 which clamp toward one another and prevent bullets from passing through the seam between the plates. Also shown in FIG. 1 is a plurality of bolts 120 and nuts 124.

To assemble the ballistic wall 100, the plates are brought together so that the holes in the plates are adjacent one another. The facing strip 112 and the backing strip 116 are placed so that holes 132 and 136 therein are in alignment with holes 134 and 138 on the plates. (To maintain simplicity in the drawings, only one hole on each plate is numbered. It will be understood that all of the holes are preferably in alignment, etc.).

Figure 2:
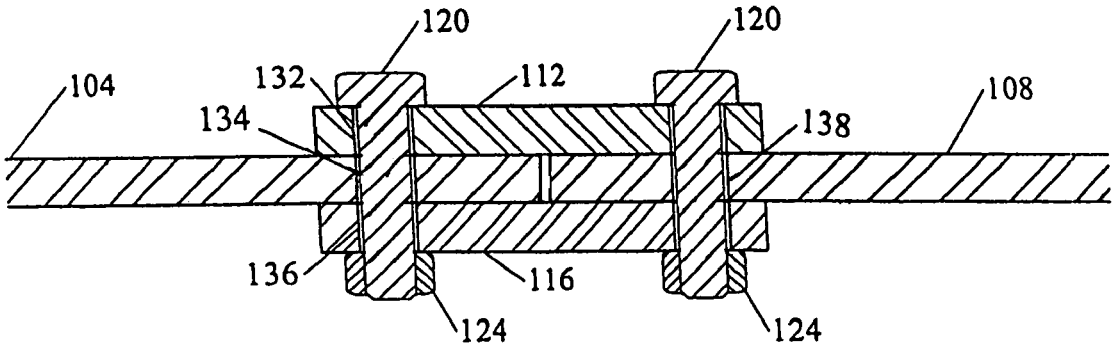
FIG. 2, shows a cross-sectional view of the joint of FIG. 1 assembled with a bullet containment frame attached thereto.

When the bolts 120 pass through holes 132, 134, 136 and 138 and the nut 124 is tightened, the facing strip 112 and the backing strip 114 clamp together against the plates 104 and 108. A cross-sectional view of a completed joint is shown in FIG. 2. Provided that sufficient nuts 124 and bolts 120 are used and the nuts are properly tightened, a highly secure joint is formed which prevents bullets from passing from one side of the plates 104 and 108 to the other.

One problem which is presented by the plates 104 and 108 is forming the hole 134 or 138. In order to make a truly bullet resistant joint, it is important to use hardened steel. Hardened steel, however, is extremely difficult to drill. Thus, if holes are to be formed in the plates, they must typically be cut with a cutting torch. While improvements in cutting torch technology have decreased the costs of cutting holes, each time the cutting torch is turned off and on there is an associated cost.

Figure 1A:
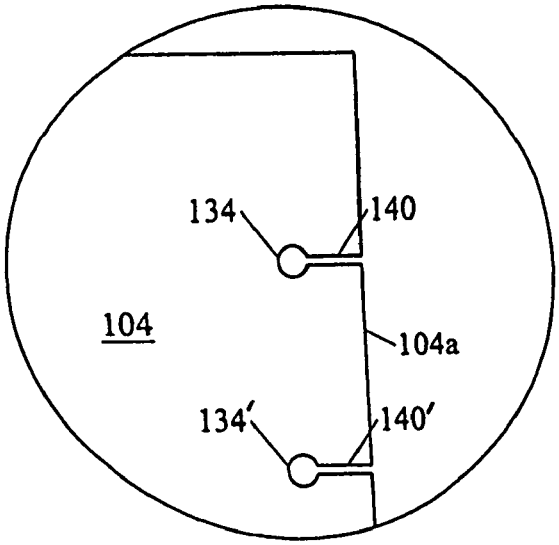
FIG. 1A shows a close-up view of a portion of one of the plates of FIG. 1.

Turning now to FIG. 1A, there is shown a solution to forming holes in the plates 104 and 108. Rather than forming a conventional hole, holes 134 and 138 are preferably formed as a keyhole. The cutting torch generally starts from the side 104*a* of the plate and cuts a thin slot 140 in the plate. The slot is preferably about 0.125 inches or less.

The slot 140 can extend into the plate any desired length. However, it is presently preferred that the slot extend into the plate about 1 inch. At the end of the slot 140, hole 134 is cut. The cutting torch then remains on and travels out through the slot 140. The cutting torch continues along the side 104*a* until it reaches the location for the next hole, where it cuts another slot 140' and another hole 134'. It has been found in accordance with the present invention that keeping the cutting torch on and cutting keyhole configurations substantially reduces the cots of cutting the holes 134 in the plate 104. Thus, the plates 104 and 108 can be formed more cost effectively, keeping down the cost of modular ballistic wall.

Because the slot 140 is about one inch long, the risk of the metal deforming and the bolt being pulled out through the slot 140 is virtually nonexistent. Furthermore, the plates 104 and 108 are held in fixed relationship to one another by the clamping action of the facing strip 112 and backing strip 116 which are clamped together by the bolts 120 and nuts 124. Thus, the configuration shown in FIGS. 1 through 2 achieves all of the advantages of a conventional through-hole design, at a lower price.

Figure 3:
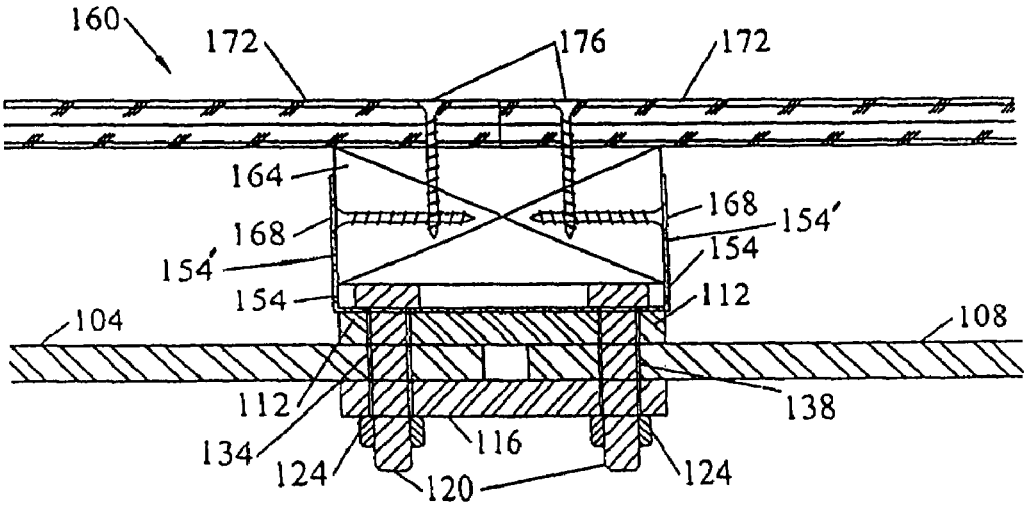
FIG. 3 shows a cross-sectional view of a joint similar to that shown in FIG. 2, but with an alternate embodiment of an attachment mechanism for the bullet containment frame and the ballistic wall.

Turning now to FIG. 3, there is shown another embodiment of the invention. The modular ballistic wall, generally indicated at 150, includes a pair of plates 104 and 108 which are attached together by a facing strip 112 and backing strip 116 and bolts 120 which extend through the facing strip, the plates and the backing strip and are secured by the nuts 124.

Attached to the facing strip 112 is a mounting bracket 154. Typically, the attachment of the mounting bracket 154 to the facing strip is accomplished by the bolts 120 which extend through holes in the mounting bracket prior to passing through the facing strip. The mounting bracket 154 is typically made of tin or some other metal, although plastic or other sufficiently durable materials can be used.

The mounting bracket 154 is also attached to a bullet containment frame, generally indicated at 160, via one or more arms 154' which extend away from the facing stip 112 and plates 104 and 108. The bullet containment frame 160 typically includes a wood post, such as a two-by-four 164 which is attached to the mounting bracket 154. When the mounting bracket 154 is made from tin or some other relatively pliable material, the two-by-four 164 can be attached by simply driving a fastener 168, such as screws or nails, etc., through the mounting bracket 154 and into the two-by-four. If desired, the mounting bracket 154 can have preformed holes through which the fasteners may be driven. In the alternative, the fasteners can simply be driven through the tin, etc., of the mounting bracket.

The bullet containment frame 160 also includes boards 172 of material, such as plywood, sheet rock and/or acoustic tiles, which are attached to the two-by-fours 164. The boards 172 are also attached by fasteners 176, such as screws, nails, or staples.

When a bullet is fired at the modular ballistic wall 150, it passes through the boards 172 and impacts against the plates 104 and 108. Because the bolts 120 and nuts 124 securely clamp the facing strip 112 and the backing strip 116 against the ends of the plate 104 and 108, a bullet is unable to pass between the plates and injure a person on the other side.

Figure 3A:
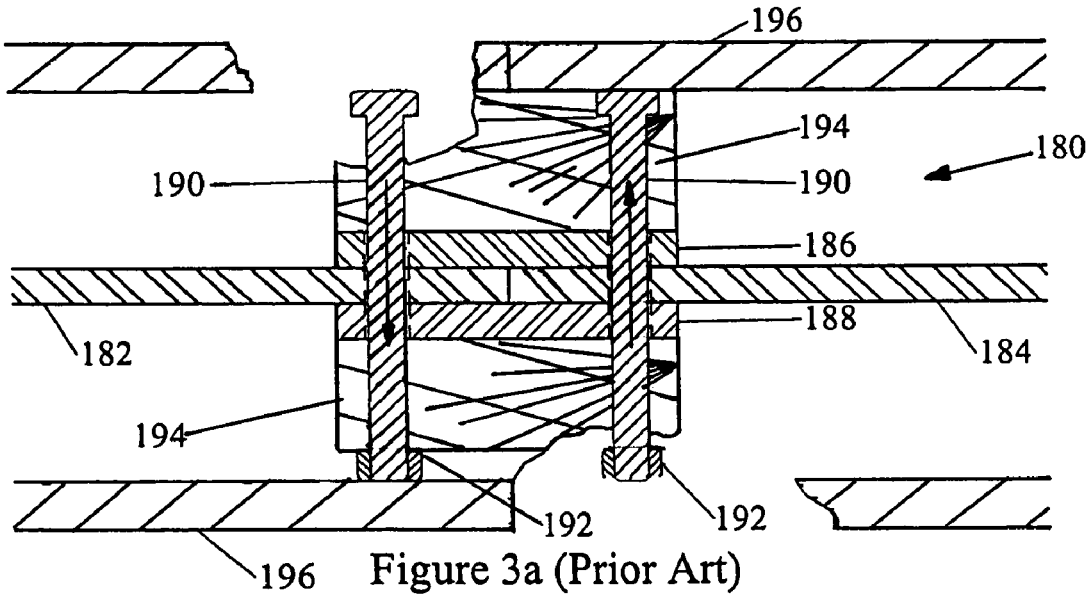
Figure 3a (Prior Art)
FIG. 3A shows a cross-sectional view of a joint made in accordance with the prior art which has been impacted by bullets.

Turning momentarily to the FIG. 3A, there is shown a cross-sectional view of a prior art configuration for a ballistic wall. The ballistic wall, generally indicated at 180, includes a pair of plates 182 and 184 which are held together by a facing strip 186 and a backing strip 188 which are clamped together by bolts 190 and nuts 192. In addition to the facing strip 186 and backing strip 188 and the plates 182 and 184, the bolts also pass through two-by-fours 194 disposed outside of the facing and backing strips. The two-by-fours 194 are also attached to pieces of plywood 196.

During use, bullets will pass through the plywood 196 and will typically impact the plates 182. Frequently, however, a bullet will impact the two-by-four 194, thereby fragmenting portions of the two-by-four. When this happens around the bolt 190, or the nut 192, the bolt no longer securely clamps the facing strip 186 and the backing strip 188 toward each other. Furthermore, such a configuration exposes the ends of the bolts to damage by bullets. Once the facing strip and backing strip 186 and 188 no longer securely clamp against the plates, the joint tends to open under the weight of the plates and the risk that a bullet fragment may pass between the plates increases significantly. Some shoot houses constructed in accordance with the prior art have been seen which have a half-inch or more gap between the facing strip and the plates.

The configuration shown in FIG. 3 resolves these concerns. Even if the two-by-four 164 were to be completely destroyed at a particular location, the damage to the two-by-four would have no impact on the bolts 120 and nuts 124 which clamp the facing strips 112 and backing strips 116 against the plates. To the contrary, the bolts are covered by the two-by-four, minimizing the risk that they will be damaged. Additionally, because fasteners 168 can be punched through the mounting bracket 154, numerous fasteners can be used, thereby ensuring against separation of the two-by-four 164 from the mounting bracket.

In addition to the benefit of increased safety obtained by the configuration in FIG. 3, an additional benefit of cost reduction is also achieved. The use of the mounting bracket 154 eliminates the need to process lumber. In the prior art configuration, the pieces of two-by-four must either be pre-drilled at the factory or drilled by hand in the field. Using the mounting bracket avoids the necessity of pre-drilling the two-by-fours. It also facilitates the purchase of the two-by-fours from local sources. Those skilled in the art will appreciate that purchasing lumber locally can reduce transportation costs and eliminates problems due to an insufficient number of two-by-fours being shipped.

Figure 3B:
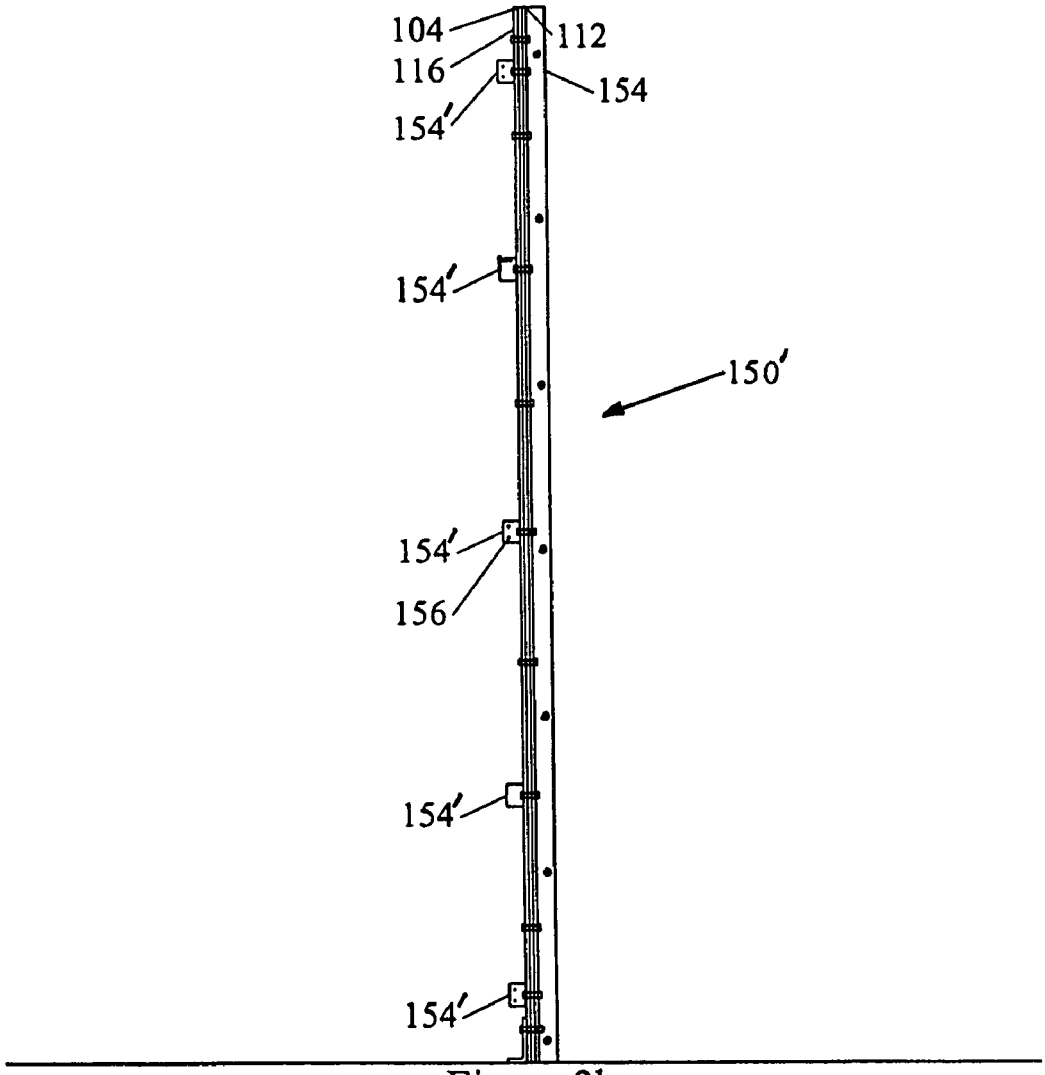
FIG. 3B shows a side view of a modular ballistic wall made in accordance with the principles of the present invention.

Turning now to FIG. 3B, there is shown a side view of a portion of a modular ballistic wall, generally indicated at 150', formed in accordance with the principles of the present invention. The ballistic wall 150' includes plates (only plate 104 of which is shown) held together by a facing strip 112 and a backing strip 116. Attached to the facing strip 112 is a mounting bracket 154 which is formed as one elongate piece which extends substantially the length of the facing strip. A plurality of mounting brackets 154' are attached to the backing strip 116. Each of the mounting brackets 154' is typically held on by a single pair of bolts. Some of the mounting brackets 154' are pre-drilled with holes 156 for receiving fasteners, preferably screws. The mounting bracket 154 may also be pre-drilled with holes 156, or fasteners may simply be driven through the wall of the mounting bracket.

Figure 4:
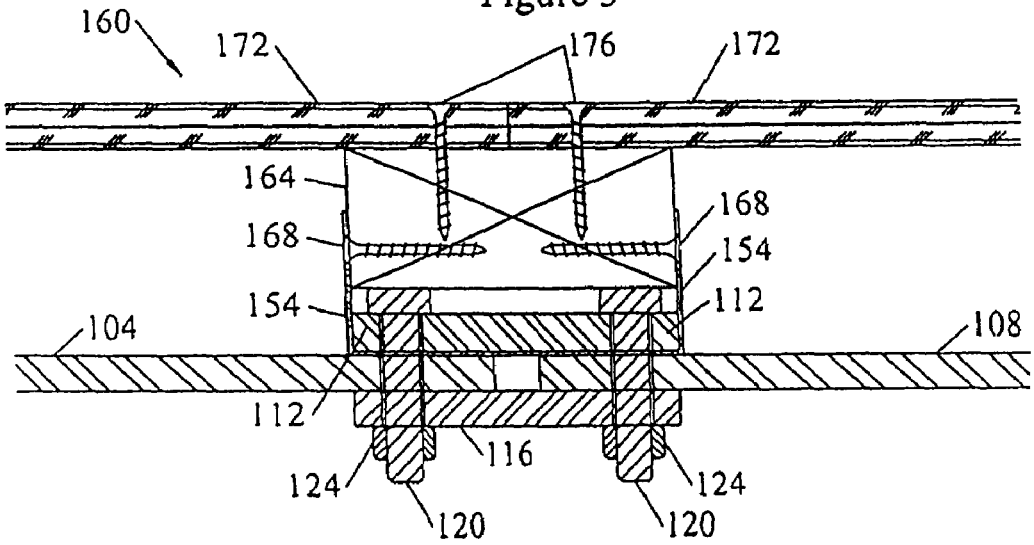
FIG. 4 shows a cross-sectional view similar to that shown in FIG. 3, but with the bracket mounted inside the facing strip.

FIG. 4 shows an alternate embodiment of the present invention which is similar to that shown in FIG. 3 and is numbered accordingly. Instead of having the mounting bracket 154 attached on the outside of the facing strip 112, the mounting bracket is disposed between the facing strip 112 and the plates 104 and 108 and then extends outwardly to engage the bullet containment frame 160'. (It should be appreciated throughout the present disclosure that references to the facing strip and the backing strip and any attachments thereto may be interchanged as either or both sides of the plates may be used to form a ballistic wall for a shoot house, etc.)

Figure 5:
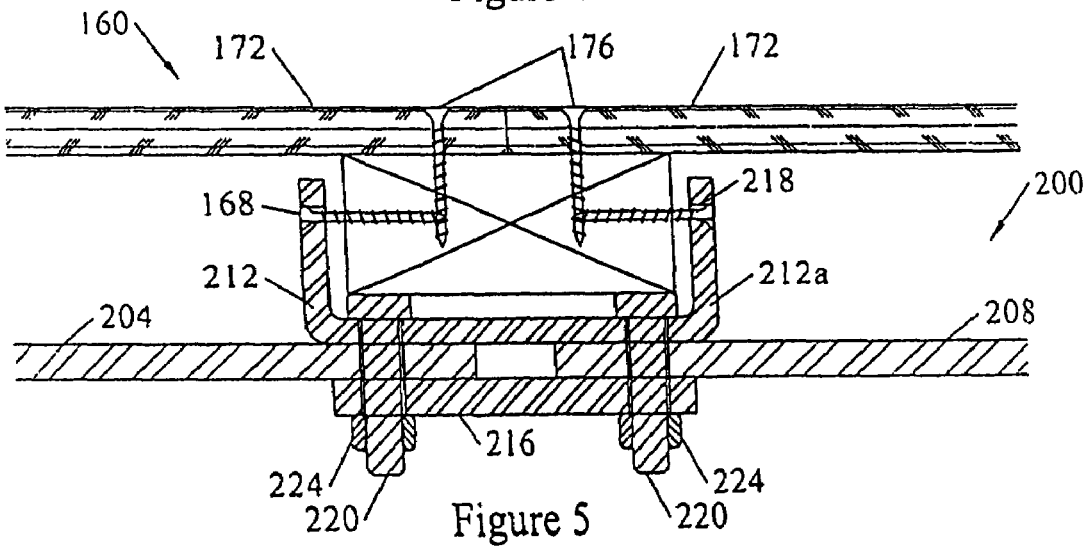
FIG. 5 shows a cross-sectional view of another attachment mechanism for connecting the facing strip to the bullet containment frame.

Turning now to FIG. 5, there is shown an alternate embodiment of the invention. The ballistic wall, generally indicated at 200, includes a plurality of plates 204 and 208. The plates 204 and 208 are held together by a facing strip 212 and a backing strip 216 clamped toward each other by a pair of bolts 220 and nuts 222 in a similar manner to that described above.

Unlike the embodiment discussed in FIGS. 3 and 3B, the ballistic wall 200 does not have an independent mounting bracket. Rather, the mounting bracket 212*a* is formed integrally with the facing strip 212. Thus, the facing strip 212 preferably has a generally U-shaped cross-section.

The facing strip 212 may have a consistent thickness throughout, or the arms which form the mounting bracket 212*a* portion of the facing strip may be thinner. If the arms are not substantially thinner, it will generally be very difficult to drive a fastener through the arms of the facing strip. Thus, it is preferred in such a configuration that holes 218 be formed in the arms to allow attachment of the bullet containment frame 160. The holes may be formed by various methods, but punching holes is presently preferred.

In addition to avoiding the need for a separate attachment bracket, the facing strip 212 shown in FIG. 4 has the advantage that the facing strip can be used for structural support. Shoot houses are often built in locations in which weather can interfere with use of the house. To resolve these concerns, it is common to build a roof above the shoot house. However, a separate support structure is usually required. Likewise, many ranges have decks above the shoot house where instructors can observe the shooter for training purposes. By using facing strips 212 which can also serve as structural support, the need for a separate support structure is eliminated.

Figure 6:
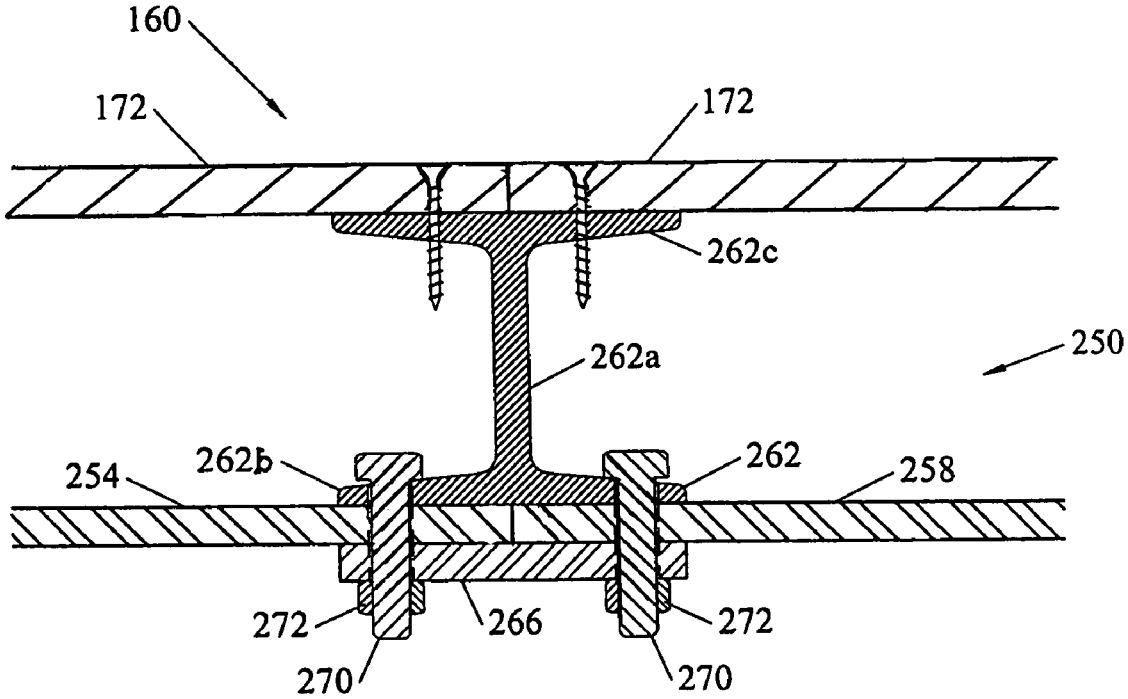
FIG. 6 shows a cross-sectional view of yet another attachment mechanism for connecting the facing strip to the bullet containment frame.

FIG. 6 shows yet another embodiment of a modular ballistic wall, generally indicated at 250, made in accordance with aspects of the present invention. The modular ballistic wall includes a pair of plates 254 and 258 which are juxtaposed so that lateral edges of the plates form a joint. The plates 254 and 258 are held together by a facing plate 262 and a backing plate 266, which clamp against the edges of the plates due to bolts 270 and nuts 272 extending therethrough.

The facing plate 262 is different from the facing plates described with respect to FIGS. 3 through 5 in that the facing plate has an arm 262*a* which extends away from a base portion 262*b* (i.e. the portion which abuts the plates) and which supports a mounting portion 216*c* for attachment to the bullet containment frame 160'. The bullet containment frame 160' is shown without the use of a wood post, such as a two-by-four. However, a two-by-four, etc. could be attached to the mounting portion 216*c*. as part of the bullet containment frame.

Those skilled in the art will appreciate that the facing plate 262 can be formed as an I beam, in which case attachment holes would typically be formed in the mounting portion 216*c*, or could be formed so that the mounting portion was sufficiently thin that fasteners could be driven through the metal, etc., used to form the mounting portion.

Figure 7:
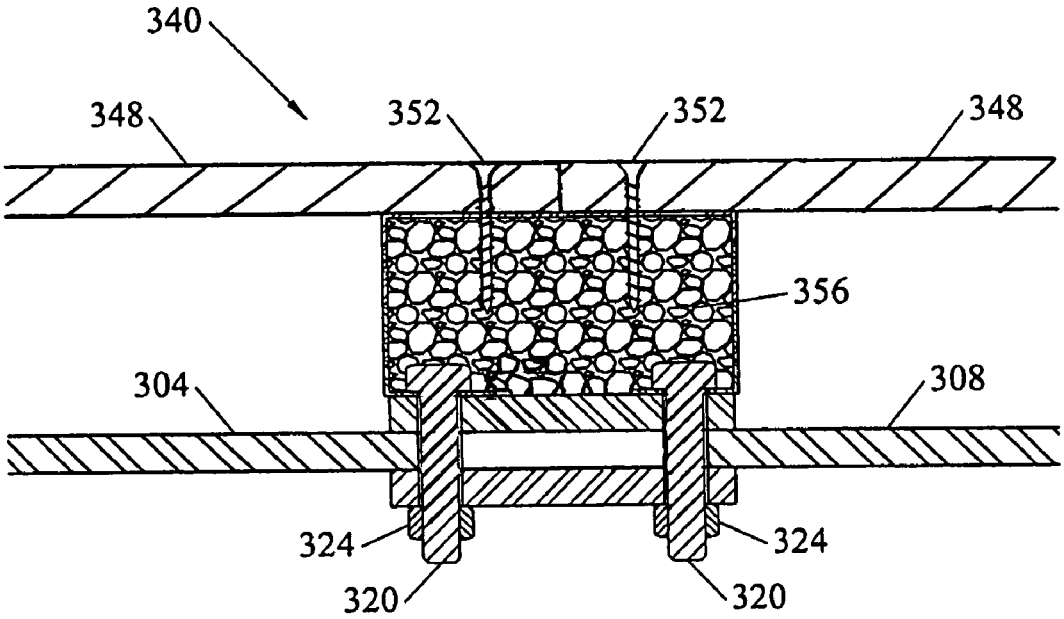
FIG. 7 shows a cross-sectional view of yet another embodiment of a modular ballistic wall in accordance with principles of the present invention.

Turning now to FIG. 7, there is shown a cross-sectional view of yet another modular ballistic wall, generally indicated at 300, formed in accordance with the principles of the present invention. The modular ballistic wall 300 includes a pair of metal plates 304 and 308 which are attached together by a facing strip 312 and a backing strip 316 which are clamped together by bolts 320 and nuts 324.

A bullet containment frame, generally indicated at 340, is attached to the facing strip 312 by the bolts 320. The containment frame 340 includes a generally hollow post, such as a tin stud 344. A pair of boards 348 are attached to the stud 344 by fasteners 352 such as screws, etc. Additionally, the hollow stud can be filled with a bullet deceleration medium 356, such as gravel or chopped rubber. If needed, the stub 344 can have grooves formed therein to allow portions of the stud to be slid between the heads of the bolts 320 and the facing strip 312 prior to tightening of the bolts.

FIGS. 8A through 8D show still further embodiments of the invention. For example, a joint, generally indicated at 400, is made between three plates 404, 408 and 412. The plates are assembled so as to form the corner of two rooms on one side and a single room or hallway on the other.

The plates are connected by a plurality of facing/backing strip. Those skilled in the art will appreciate that the facing strip is typically used to reference the strip on the side of the shooter, while the backing strip is disposed on the side of the plates 404, 408, 412 opposite the shooter. Thus, a facing strip may also be a backing strip, and vice versa, when viewed from the opposite side of the wall.

Facing strip 420 and 422 are formed with an L-shaped cross-section so as to enable plate 404 to be held at a 90 degree angle from plates 408 and 412, respectively. Facing strip 424 is generally flat to connect the plates 408 and 412 together. The facing strips 420, 422, 424 are drawn toward the backing strips opposite the plates. Thus, for example, tightening the nuts 426 on bolts 428 drawing the facing strip 424 towards its backing strips (facing strips 420 and 422) which also draws one of the backing strips (facing strip 424) toward each of the facing strips 420 and 422. Tightening the other nut 426*a* and bolt 428*a* likewise draws the facing strips 420 and 422 toward their respective backing strips (facing strips 422 and 420, respectively).

Figure 8A:
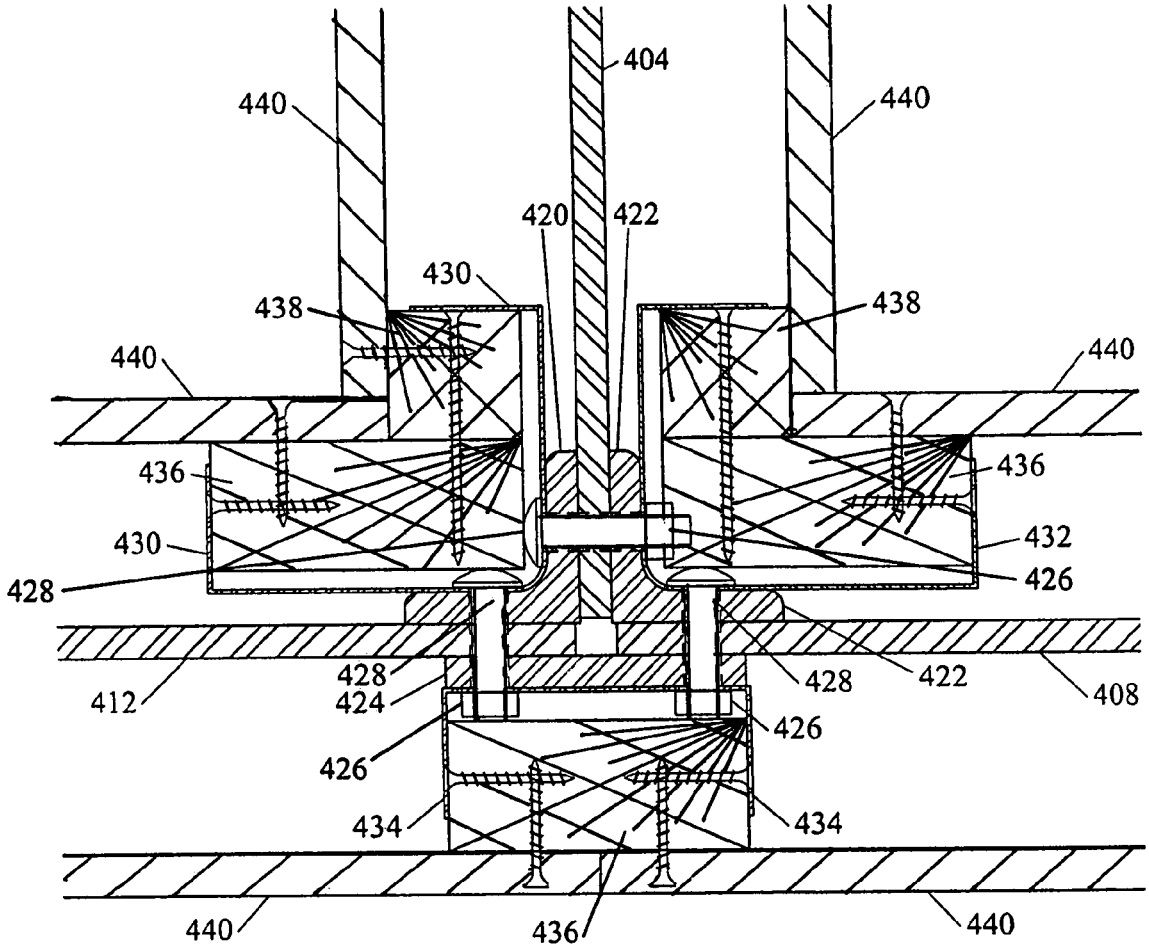
FIGS. 8A through 8D show cross-sectional views of other attachment configurations in accordance with the principles of the present invention.

One advantage of the configuration shown in FIG. 8A is that the wall formed around plate 404 can be exactly 4 feet on center. This can reduce the cost of materials, as most sheets of material, whether steel or plywood, can be purchased in 4 foot increments.

Each of the facing strips 420, 422 and 424 is attached to a mounting bracket 430, 432 and 434 respectively. Mounting brackets 430 and 432 form a generally L-shaped recess which can receive a two-by-four 436 and a two-by-two 438 for mounting the boards 440 of plywood, sheet rock, etc. With the mounting brackets 430 and 432 attached to the facing strips 420 and 422, the two-by-fours 436 and two-by-twos 438 can be readily attached by driving a screw through the mounting bracket (or through a hole therein). Once the two-by-fours 436 and two-by-twos 438 are in place, it is relatively easy to attach the boards 440 forming the exterior of the bullet containment frame.

Unlike the L-shaped facing strips 420 and 422, facing strip 424 is generally flat. Thus, the mounting bracket is U-shaped to receive a two-by-four 436, and the attached boards 440.

In such a configuration, a joint can be formed which, from the exterior, resembles a wall of a house. The joint is easy to assemble, and avoids the need for pre-drilled lumber and awkward mounting structures for securing the boards 440 which form the exterior of the modular ballistic wall. Additionally, the posts (two-by-fours and two-by-twos) are secured to each plate via the mounting brackets 430, 432, and 344, thereby minimizing the risk of the posts and/or boards pulling away from the metal plates. In the prior art embodiment discussed in FIG. 3A, the boards occasionally pulled away from the metal plates. Of course, if the boards pull away sufficiently, a shooter or observer could be hit by a ricochet which fails to impact the boards.

Figure 8B:
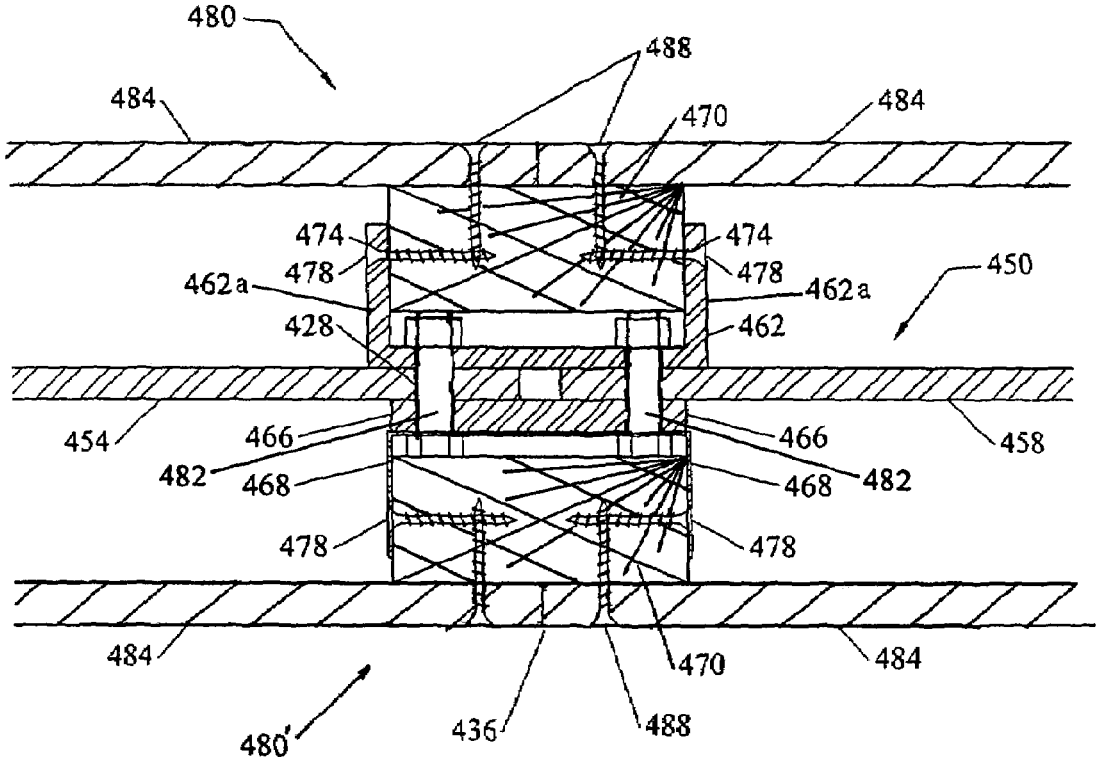

Turning to FIG. 8B, there is shown an alternate embodiment of the invention. The modular ballistic wall, generally indicated at 450, includes a pair of steel plates 454 and 458. The steel plates 454 and 458 are held together by strips 462 and 466. Strips 462 and 466 serve as facing strips and backing strips depending on the direction of fire. For example, if a shooter were firing from the bottom of the page, strip 466 would form a facing strip, while strip 462 would serve as a backing strip. Regardless of which a strip is called, the fundamental purpose of the strips is to clamp against the ends of the plates and to prevent bullets from passing through the seam formed by the plates.

Facing strip 462 is formed from a piece of metal having a generally U-shaped cross-section with two arms 462*a* which form a channel for receiving the post, two-by-four 470. The arms 462*a* are pre-drilled with holes 474 to facilitate placement of fasteners, screws 478 into the two-by-four 470 to secure the bullet containment frame, generally indicated at 480, to the facing strip 462. The boards 484 are also attached to the two-by-four 470 by fasteners, such as screws 488.

On the opposing side, the bullet containment frame, generally indicated at 480', is attached a mounting bracket 468 by a plurality of fasteners, such as screws 478. The mounting bracket 468 is, in turn, secured to the facing strip 466 by the bolts 482 which clamp the strips 466 and 462 toward one another and against the plates 454 and 458. In either the configuration used to attach bullet containment frame 480 or bullet containment frame 480', the two-by-four 470 can be virtually pulverized without affecting the joint formed by the strips 466 and 462 clamping against the plates 454 and 458. Thus, the risk that a bullet or bullet fragment will pass between the plates is virtually eliminated.

The embodiment shown in FIG. 8B has the additional advantage that facing strip 462 forms a support structure which can be used to support overhead walkways, a roof, etc. above the modular ballistic wall 450. This eliminates the need for a separate support structure as is commonly used with prior art configurations.

Figure 8C:
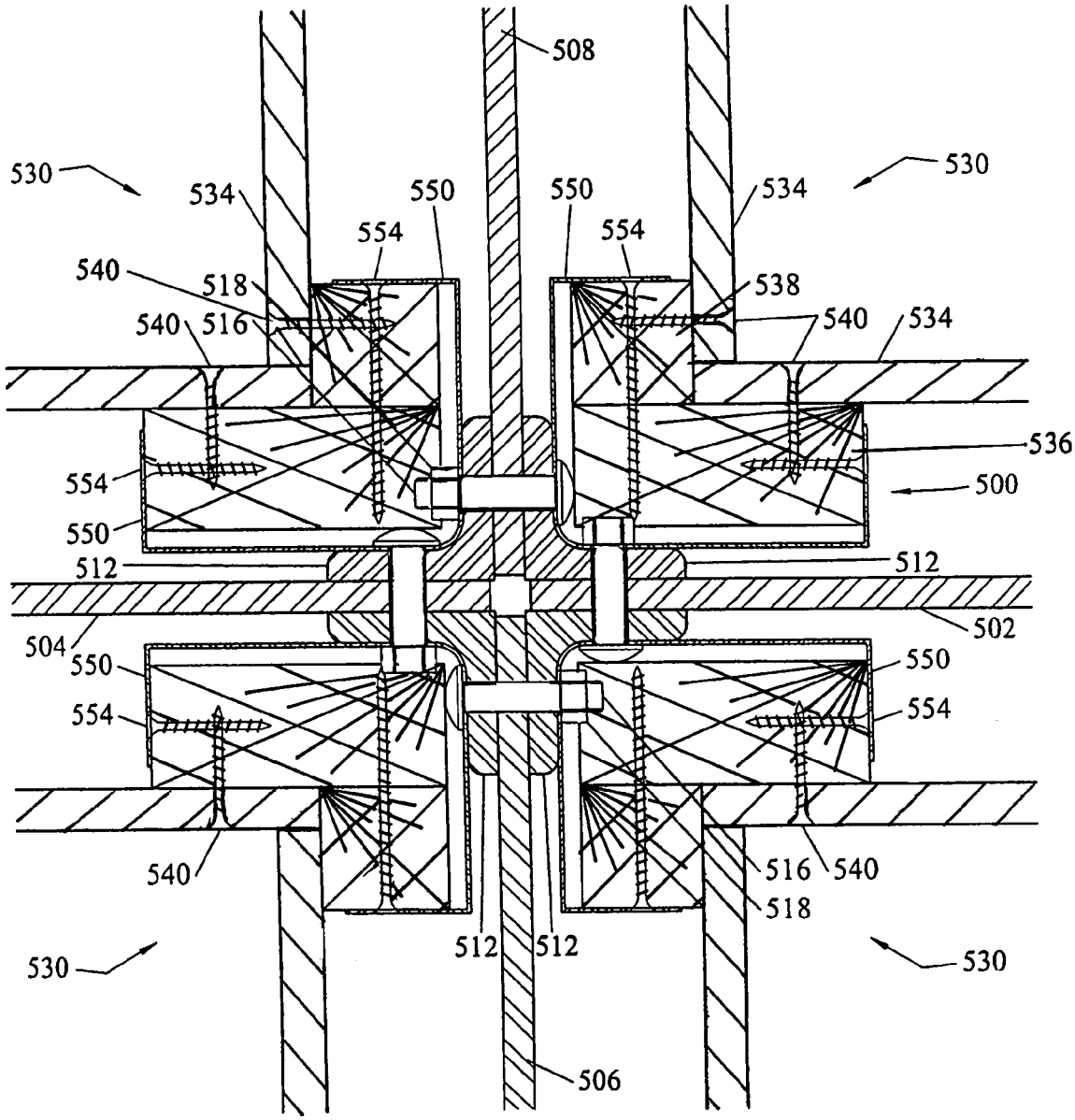

FIG. 8C shows yet another configuration made in accordance with the present invention. The modular ballistic wall, generally indicated at 500, includes a plurality of metal plates 502, 504, 506 and 508, which are preferably made from plate steel. Each plate 502, 504, 506 and 508 is attached to two of the other plates by facing strips 512. Each of the facing strips 512 also is a backing strip for two of the other facing strips depending on the angle of fire.

Bolts 516 and nuts 518 are used to attach the facing strips 512 so that they clamp against the plates 502, 504, 506 and 508 and form a bullet resistant joint. A bullet containment frame, generally indicated at 530, is formed by boards 534, typically plywood, which are attached to support posts, two-by-fours 536 and two-by-twos 538, by fasteners 540, such as screws, nails, staples, etc. The support posts are, in turn, attached by fasteners 554 to mounting brackets 550 which are attached to the facing strips 512 by the bolts 516 and nuts 518.

Figure 8D:
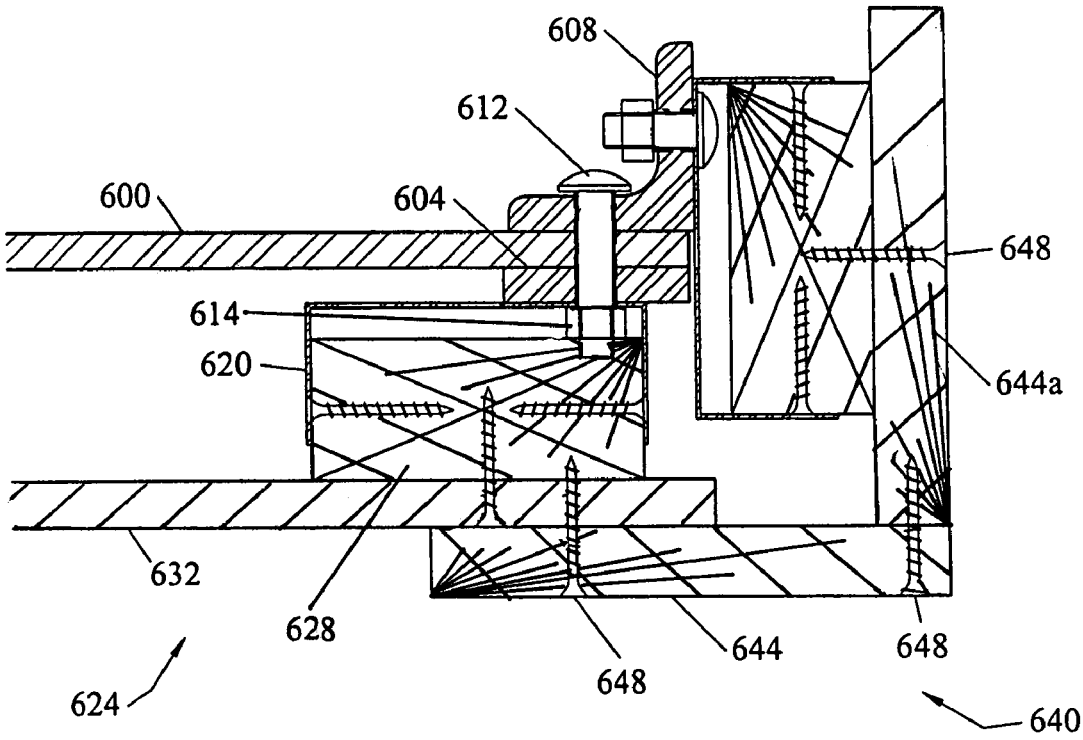

While the facing strips and mounting brackets described herein form extremely effective bullet resistance joints, they can also be used to build additional structures ancillary to construction of the shoot house. FIG. 8D shows the end of a wall as it might be configured for mounting a door. The structure includes a metal plate 600 having a facing strip 604 and a backing strip 608 attached thereto by a bolt 612 and nut 614. The tightening nut 614 holds a mounting bracket 620 to the facing strip 604 so that a bullet containment frame, generally indicated at 624 can be attached thereto. As with previous embodiments, the bullet containment frame includes a post 628 attached to the mounting bracket 620, and boards 632 attached to the post.

Also shown in FIG. 8D is a fascia structure, generally indicated at 640. The fascia structure includes a pair of boards 644. One board is attached to the board 632 of the bullet containment frame 624 by a fastener, such as a screw 644. The other board 644*a* is attached by a fastener 648 to a support post 650, which is attached to a mounting bracket 654, which is bolted to the backing strip 608. The two boards 644 and 644*a* are also attached together by a fastener. In such a manner, a fascia can be created, such as is used to mount a door, etc., without the need for any milled lumber. (As used herein milled lumber is lumber which has had holes formed therethrough for mounting to the facing strip, etc., whereas as used herein unmilled means that the lumber lacks attachment holes extending therethrough.) In fact, all of the lumber used as shown herein can be purchased from local hardware stores, thereby saving transportation costs. Furthermore, the method of attaching the lumber to the steel plates provides for a safer shoot house, etc., as even repeated shots into the support posts will not loosen the joints.

Thus there is disclosed an improved apparatus and method for forming a modular ballistic wall. Those skilled in the art will appreciate numerous modifications which can be made without departing from the scope and spirit of the present invention. For example, rather than screws or nails, other fasteners such as straps, or rivets could be used. The appended claims are intended to cover such modifications.

What is claimed is:

1. A modular ballistic wall for decelerating bullets, the ballistic wall comprising:
- a first metal plate having an edge, a plurality of holes formed adjacent the edge, and a plurality of slots connecting the holes to the edge;
- a second metal plate having an edge and a plurality of holes formed adjacent the edge;
- a facing strip having a plurality of holes formed therein in alignment with the plurality of holes formed in the first metal plate and the plurality of holes in the second metal plate;
- a first plurality of bolts and nuts attaching the facing strip to the metal plates by extending through the holes in the facing strip and the plurality of holes formed in the first metal plate; and
- a second plurality of bolts and nuts attaching the facing strip to the metal plates by extending through the holes in the facing strip and the and the plurality of holes formed in the second metal plate;
- a bullet containment frame attached to the facing strip; and
- a mounting bracket connecting the bullet containment frame to the facing strip, the mounting bracket having a generally U-shaped cross-section defining a channel, and wherein the bullet containment frame comprises a support post which fits within the channel.

2. The modular ballistic wall according to claim 1, further comprising a backing strip disposed on a side of the metal plates opposite the facing strip and having a plurality of holes formed therein in alignment with the plurality of holes formed in the first metal plate and the plurality of holes formed in the second metal plate.

3. The modular ballistic wall according to claim 1, wherein at least one of the first or second plurality of bolts extend through the mounting bracket, but not into the bullet containment frame.

4. The modular ballistic wall according to claim 1, wherein the support post is attached to the mounting bracket by screws.

5. The modular ballistic wall according to claim 1, wherein the second plate comprises a plurality of slots connecting the holes to the edge.

6. A modular ballistic wall for decelerating bullets comprising:
- two pieces of plate steel;
- a facing strip disposed to clamp against the two pieces of plate steel and hold the two pieces of plate steel together;
- a mounting bracket coupled to the facing strip;
- a plurality of bolts and nuts, the bolts extending through the mounting bracket and the facing strip; and
- a bullet containment frame attached to the mounting bracket, the bullet containment frame and at least a portion of the mounting bracket being disposed in front of the facing strip and two pieces of plate steel such that a bullet would pass through at least a portion of the bullet containment frame prior to impacting one of the two pieces of steel plate and, wherein the plurality of bolts do not hold the bullet containment frame to the mounting bracket.

7. The modular ballistic wall according to claim 6, wherein the bullet containment frame comprises a wood post, and wherein the wood post is fastened to the mounting bracket.

8. The modular ballistic wall according to claim 7, wherein the mounting bracket is made of metal, and wherein the wood post is attached to the mounting bracket by a fastener which has been driven through the mounting bracket.

9. The modular ballistic wall according to claim 7, wherein the mounting bracket has holes formed, the holes receiving fasteners to fasten the mounting bracket to the wood post.

10. The modular ballistic wall according to claim 7, wherein the post is unmilled.

11. The modular ballistic wall according to claim 6, wherein the mounting bracket comprises at least one arm extending away from the two pieces of plate steel.

12. The modular ballistic wall according to claim 6, wherein the mounting bracket has a generally U-shaped cross-section.

13. The modular ballistic wall according to claim 6, wherein the mounting bracket has a generally L-shaped recess and holds a support post of the bullet containment frame.

14. The modular ballistic wall according to claim 13, wherein the facing strip has an L-shaped cross-section.

15. A modular ballistic wall comprising;
- a first piece of steel plate having an edge;
- a second piece of steel plate having an edge disposed adjacent the edge of the first piece of steel plate;

a facing strip disposed so as to cover one side of said edges of the first piece of steel plate and the second piece of steel plate;

a backing strip disposed so as to cover said edges of the first piece of steel plate and the second piece of steel plate on a side opposite the facing strip;

at least one arm connected to the facing strip and extending away from the first piece of steel plate and the second piece of steel plate; and a bullet containment frame coupled to the at least one arm by a plurality of fasteners, the bullet containment frame comprising sheets of material spaced apart from the first piece of plate steel and second piece of plate steel and positioned in front of the first piece of plate steel and the second piece of plate steel to contain bullets ricocheting off the first piece of plate steel and the second piece of plate steel.

16. The modular ballistic wall according to claim 15, wherein the at least one arm is a mounting bracket attached to the facing strip.

17. The modular ballistic wall according to claim 15, wherein at least one of the facing strip and the backing strip has a generally U-shaped cross-section so as to form a support structure, the generally U-shaped cross-section defining a channel.

18. The modular ballistic wall according to claim 17, wherein the bullet containment frame comprises a post which is at least partially disposed in the channel.

19. The modular ballistic wall according to claim 18, wherein the post is a standard, unmilled post.

20. The modular ballistic wall according to claim 18, further comprising fasteners, the fasteners holding the post at least partially in the channel and wherein a plurality of holes are formed in the at least one of the facing strip and the backing strip, the holes receiving the fasteners.

21. A modular ballistic wall, comprising:

a pair of adjacent metal plates having adjacent edges;

a facing strip covering the adjacent edges of the pair of adjacent metal plates, an attachment mechanism, wherein the facing strip is attached to each of the pair of adjacent metal plates by the attachment mechanism;

a wood post attached to the facing strip such that the wood post completely covers the attachment mechanism;

wherein the attachment mechanism is a plurality of bolts and wherein all of the bolts are disposed behind the wood post to thereby protect the bolts from being impacted by bullets; and a mounting bracket, wherein the bolts hold the mounting bracket to the facing strip and the wood post is attached to the mounting bracket independent of the bolts.

22. The modular ballistic wall according to claim 21, wherein the wood post is attached to the mounting bracket by screws.

23. The modular ballistic wall according to claim 21, wherein the mounting bracket forms a generally L-shaped recess the wood post.

24. A modular ballistic wall, comprising metal plates joined together by a facing strip and covered by a bullet containment frame disposed in front of the facing strip and metal plates, characterized in that bolts attaching the facing strip to the metal plates do not extend into the bullet containment frame.

25. A modular wall for stopping bullets, the wall comprising:

a plurality of steel plates attached together by a facing strip;

a generally U-shaped mounting bracket attached to the facing strip; and a plurality of sheets of material for inhibiting ricocheting of bullets impacting the plates;

wherein the mounting bracket spaces the plurality of sheets from the facing strip.

26. The modular wall of claim 25, wherein a bullet deceleration medium is disposed between a portion of the mounting bracket and the facing strip.

27. The modular wall according to claim 26, wherein the bullet deceleration medium comprises gravel.

28. The modular wall according to claim 26, wherein the bullet deceleration medium comprises chopped rubber.

* * * * *

UNITED STATES PATENT AND TRADEMARK OFFICE

CERTIFICATE OF CORRECTION

PATENT NO. : 7,621,209 B2
APPLICATION NO. : 10/602547
DATED : November 24, 2009
INVENTOR(S) : Kyle Bateman et al.

It is certified that error appears in the above-identified patent and that said Letters Patent is hereby corrected as shown below:

Title Page:

Item (73), it reads "Assignee: Action Target Acquisition Crop."; should read --Assignee: Action Target Acquisition Corp.--

Column 1:

Line 32, it reads "the officer faces..."; should read --...the officers face...--

Column 1 :

Line 33, it reads "...constructed out of a concrete,"; should read --...constructed out of concrete,--

Column 4:

Line 35, it reads "the cots of cutting..."; should read --the cost of cutting...--

Column 4:

Line 62, it reads "...the facing stip..."; should read --...the facing strip...--

Column 9

Line 65, it reads "...and the and the plurality..."; should read --...and the plurality...--

Column 12:

Line 18, it reads "recess the wood post."; should read --recess on the wood post.--

Signed and Sealed this
Twelfth Day of July, 2011

David J. Kappos

David J. Kappos
*Director of the United States Patent and Trademark Office*